US009162461B2

(12) United States Patent
Kumagai

(10) Patent No.: US 9,162,461 B2
(45) Date of Patent: Oct. 20, 2015

(54) INK JET RECORDING APPARATUS AND RECORDING METHOD

(71) Applicant: Seiko Epson Corporation, Tokyo (JP)

(72) Inventor: Shiki Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/623,818

(22) Filed: Feb. 17, 2015

(65) Prior Publication Data

US 2015/0231885 A1 Aug. 20, 2015

(30) Foreign Application Priority Data

Feb. 18, 2014 (JP) ..... 2014-028913

(51) Int. Cl.
*B41J 2/165* (2006.01)

(52) U.S. Cl.
CPC ..... *B41J 2/16505* (2013.01); *B41J 2/16517* (2013.01); *B41J 2/16585* (2013.01)

(58) Field of Classification Search
CPC ..... B41J 2/16505; B41J 2/16517; B41J 2/16523; B41J 2/16526; B41J 2/16585
USPC ..... 347/22, 29, 30, 33
See application file for complete search history.

(56) References Cited

U.S. PATENT DOCUMENTS 7,794,041 B2 * 9/2010 Akase et al. ..... 347/19
8,936,346 B2 * 1/2015 Kawakami et al. ..... 347/29
2013/0300799 A1 * 11/2013 Mizutani et al. ..... 347/30

FOREIGN PATENT DOCUMENTS

JP 2001-171154 A 6/2001

* cited by examiner

*Primary Examiner* — An Do
(74) *Attorney, Agent, or Firm* — Harness, Dickey & Pierce, P.L.C.

(57) ABSTRACT

There is provided an ink jet recording apparatus including a recording head in which nozzle arrays are configured by lining up a plurality of nozzles which discharge identical inks and the nozzle arrays are arranged in a plurality of lines, and which discharges a plurality of types of ink, and a cap member which covers the plurality of the nozzle arrays in which out of a plurality of nozzle arrays which are accommodated in one cap member in a capping operation, a nozzle array in an end side region of the cap member discharges ink with the lowest solid content concentration and a nozzle array in a central region of the cap member discharges ink with highest solid content concentration.

16 Claims, 4 Drawing Sheets

INK JET RECORDING APPARATUS AND RECORDING METHOD

BACKGROUND

1. Technical Field

The present invention relates to an ink jet recording apparatus and a recording method.

2. Related Art

In the related art, a printing method which uses an ink jet recording system is executed by causing small droplets of ink to fly and be attached to a recording medium such as paper. Due to recent innovative progress in ink jet recording system techniques, ink jet recording apparatuses which use an ink jet recording system are used even in the field of high-definition image recording (image printing) in which photographic or off-set printing has been used up to now. For example, JP-A-2001-171154 discloses an ink jet recording apparatus where an array of nozzles is regulated in order to improve the image quality.

In ink jet recording apparatuses, when moisture and other volatile components which are included in the discharged ink evaporate, the viscosity of the ink increases (thickens). The thickened ink causes clogging in the nozzles and ink discharge defects are generated. In recent ink jet recording, in order to perform high-definition recording, the amounts of the ink droplets which are discharged are minute amounts of several pL, the diameter of the nozzles which discharge the ink is small, and the energy which is necessary for the ink discharge is also small. Since the nozzle diameter is small and the ink discharge energy is also small, nozzle clogging has a great influence on the ink discharging. In order to prevent ink from thickening due to the drying of the nozzles, ink jet recording apparatuses which are provided with a cap member have been proposed.

There are also cases where the cap member described above is used for a flushing operation or a suctioning operation which suctions ink of a recording head. However, in this case, a problem may occur where the ink is attached to an edge section of the cap member during flushing and the ink solidifies. As a result, there are cases where, without being able to sufficiently adhere the edge section of the cap member to the recording head, it is not possible to maintain negative pressure and defects occur in the operation of suctioning ink of the recording head. In addition, without being able to effectively seal the nozzles in a left-to-stand state, there is a problem in that the nozzles become dry.

SUMMARY

An advantage of some aspects of the invention is that it provides an ink jet recording apparatus which prevents nozzle clogging by preventing the generation of capping defects due to ink solidifying on an edge section of a cap member.

The present inventors carried out intensive research. As a result, the invention was completed by adjusting the arrangement of nozzles in a recording head.

According to an aspect of the invention, there is provided an ink jet recording apparatus including a recording head in which nozzle arrays are configured by lining up a plurality of nozzles which discharge identical inks and the nozzle arrays are arranged in a plurality of lines, and which discharges a plurality of types of ink, and a cap member which covers the plurality of the nozzle arrays in a left-to-stand state, in which the cap member is used for an operation of suctioning ink in the recording head in a state where the plurality of the nozzle arrays are covered, a flushing operation which receives ink from the recording head in a state of being separated from the recording head, and a capping operation which protects the nozzles by covering the plurality of the nozzle arrays in a left-to-stand state, and out of a plurality of nozzle arrays which are accommodated in one cap member in a capping operation, a nozzle array in an end side region of the cap member discharges ink with the lowest solid content concentration and a nozzle array in a central region of the cap member discharges ink with the highest solid content concentration.

In this case, since the invention is configured such that, out of a plurality of nozzle arrays which are accommodated in one cap member, a nozzle array in an end side region of the cap member discharges ink with the lowest solid content concentration, even in a case where ink with a low solid content concentration is attached to the edge section of the cap member, the amount of the solid content which is accumulated on the edge section of the cap member is suppressed. In addition, since the invention is configured such that a nozzle array in the central region of the cap member discharges ink with the highest solid content concentration, it is possible to separate the edge section of the cap member and the nozzle array which discharges ink with a high solid content concentration, and the accumulation of the solid content of the ink on the edge section of the cap member is suppressed.

It is preferable that two nozzle arrays in the end side region of the cap member discharge two types of ink with the lowest solid content concentration. In this case, the amount of the accumulated solid content is suppressed in the edge section which corresponds to both end sections of the cap member.

It is preferable that the solid content concentration of ink fills a nozzle array in the end side region of the cap member be 4 mass % or less. In this case, the amount of the solid content which is accumulated on the edge section of the cap member is suppressed.

It is preferable that each of the plurality of types of ink contain glycerin and, out of nozzle arrays which are accommodated in one cap member, that a difference in glycerin content between an ink where the glycerin content is the highest and an ink where the glycerin content is the lowest be 4% or less. In general, when ink contains a solvent with a high boiling point such as glycerin, the drying of the ink is suppressed. However, in a case where there is a nozzle which discharges ink with a remarkably low glycerin content, in a state where the recording head is capped with the cap member, a phenomenon may occur where the solvent moves from a nozzle filled with ink with a high glycerin content to a nozzle filled with ink with a low glycerin content. As a result, the viscosity of the ink changes and the ink discharge property is unstable. In this case, it is possible to prevent the solvent from moving between the inks.

It is preferable that two nozzle arrays which are provided with two or more cap members and which discharge inks for which the difference in the glycerin content exceeds 4% be arranged in regions of cap members which are different from each other. In this case, even in a case where the recording head is provided with two nozzle arrays which discharge inks for which the difference in the glycerin content exceeds 4%, it is possible to prevent the solvent from moving between the inks in a state of being capped with the cap member since it is possible to suppress the difference in the glycerin content in a plurality of nozzle arrays which are accommodated in one cap member to 4% or less.

It is preferable that each nozzle discharge liquid droplets of ink which are 4 pL or less. Since the nozzles which discharge liquid droplets of ink in minute amounts have a small nozzle diameter and also have a small ink discharge energy, nozzle clogging has a great influence on the ink discharging. In this case, it is possible to suppress the nozzle clogging and suppress discharge defects of ink even in nozzles which discharge liquid droplets of ink in minute amounts.

It is preferable that an ink absorbing material be provided in the cap member. It is possible to seal nozzles which are arranged in the recording head in a capping operation while quickly absorbing ink from the recording head in a flushing operation.

It is preferable that the invention be configured so as to perform an operation of suctioning ink in the cap member after the flushing operation. By suctioning ink which is present in the cap member early on, it is possible to prevent the ink from overflowing to the edge section of the cap member and it is possible to suppress accumulation of the solid content of the ink on the edge section of the cap member.

According to another aspect of the invention, there is provided an ink jet recording method which discharges ink with respect to a recording medium using the ink jet recording apparatus according to the aspect. In this case, since it is possible to suppress the drying of ink nozzles and since it is possible to suppress nozzle clogging or changes in the ink viscosity, it is possible to provide an ink jet recording method with increased ink discharge stability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, detailed description will be given of forms for embodying the invention. Here, the invention is not limited to the following embodiments and it is possible to embody the invention by changing the forms in various ways within the range of the gist of the invention.

Ink Jet Recording Apparatus

One embodiment of the invention relates to an ink jet recording apparatus (also simply referred to below as a "recording apparatus").

Description will be given with reference to the diagrams by using an on-carriage type serial printer (also simply referred to below as a "printer") as an example of the ink jet recording apparatus. Here, serial printers perform recording while a print head (a recording head, also referred to below as a "head") moves back and forth in a direction which intersects with a transport direction of a recording medium. Among these printers, in an on-carriage type serial printer, an ink cartridge (an ink tank) is mounted on a carriage along with a head and the carriage holds the ink cartridge which accommodates ink so as to be able to be attached and detached. Here, one embodiment of the invention may be a line printer.

Here, the scale of each of the members is appropriately changed in the diagrams which are used the description below in order to set each of the members to a recognizable size.

1. Configuration of Apparatus

Figure 1:
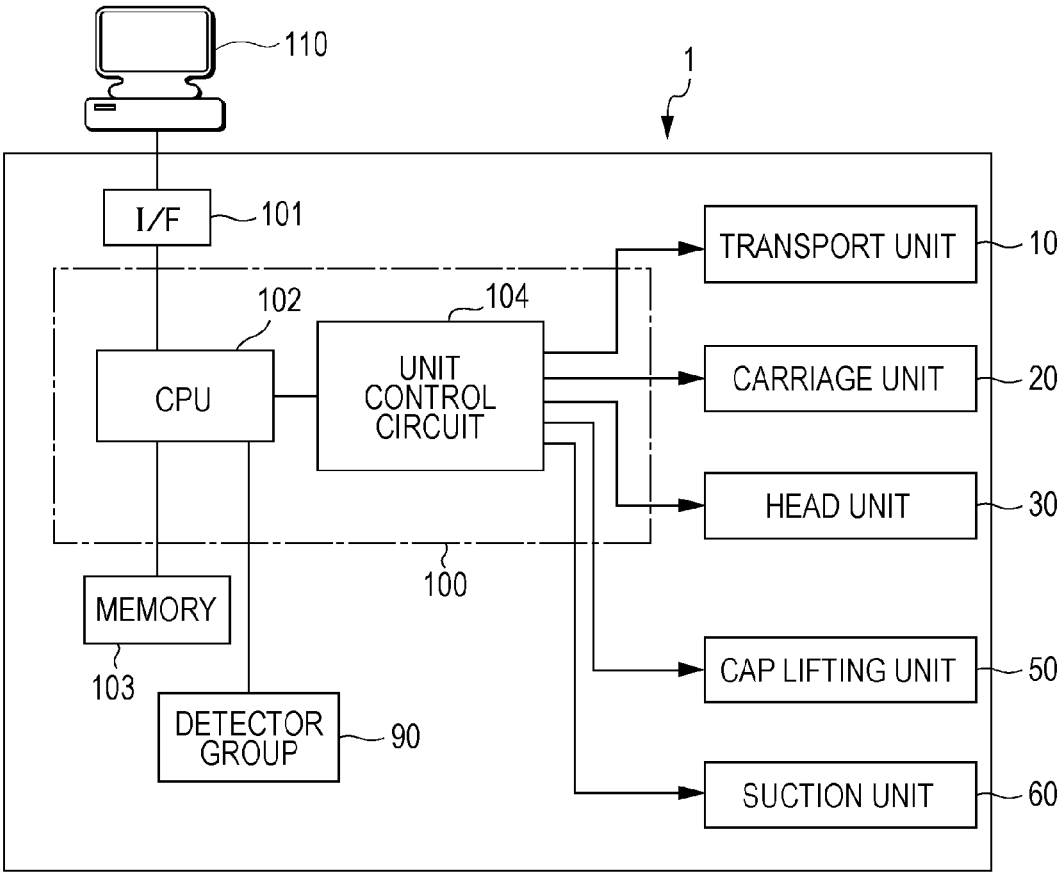
FIG. 1 is a block diagram which shows an example of a configuration of an ink jet recording apparatus according to one embodiment of the invention.
Figure 2:
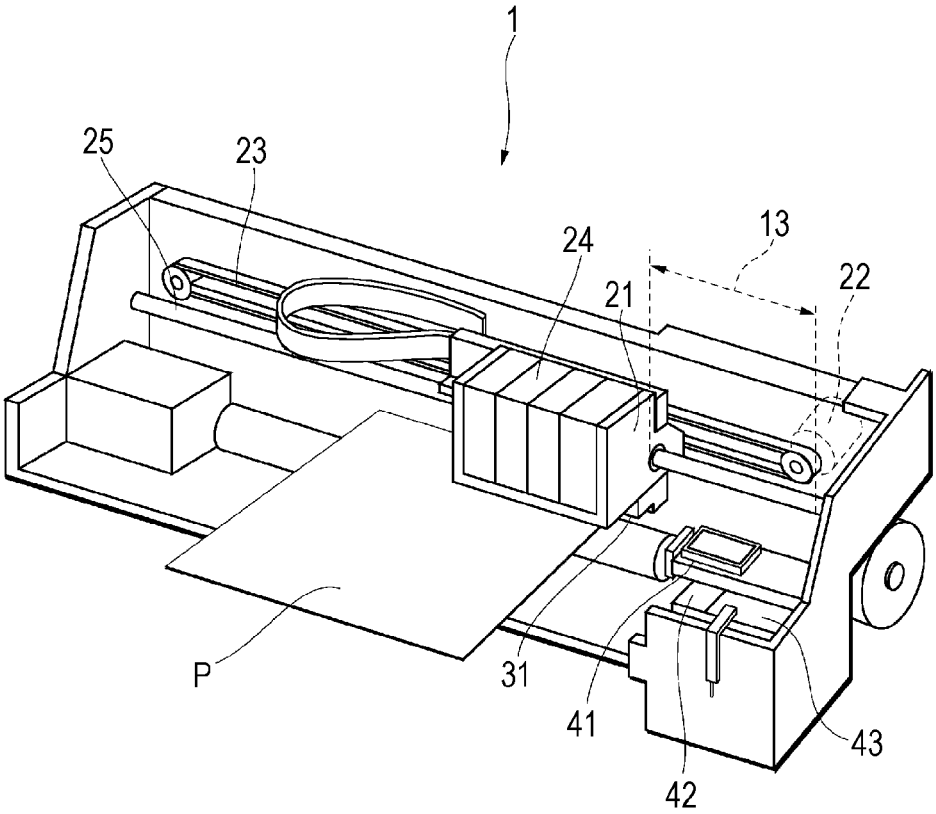
FIG. 2 is a perspective diagram which shows an example of a schematic configuration of the ink jet recording apparatus according to one embodiment of the invention.
Figure 3:
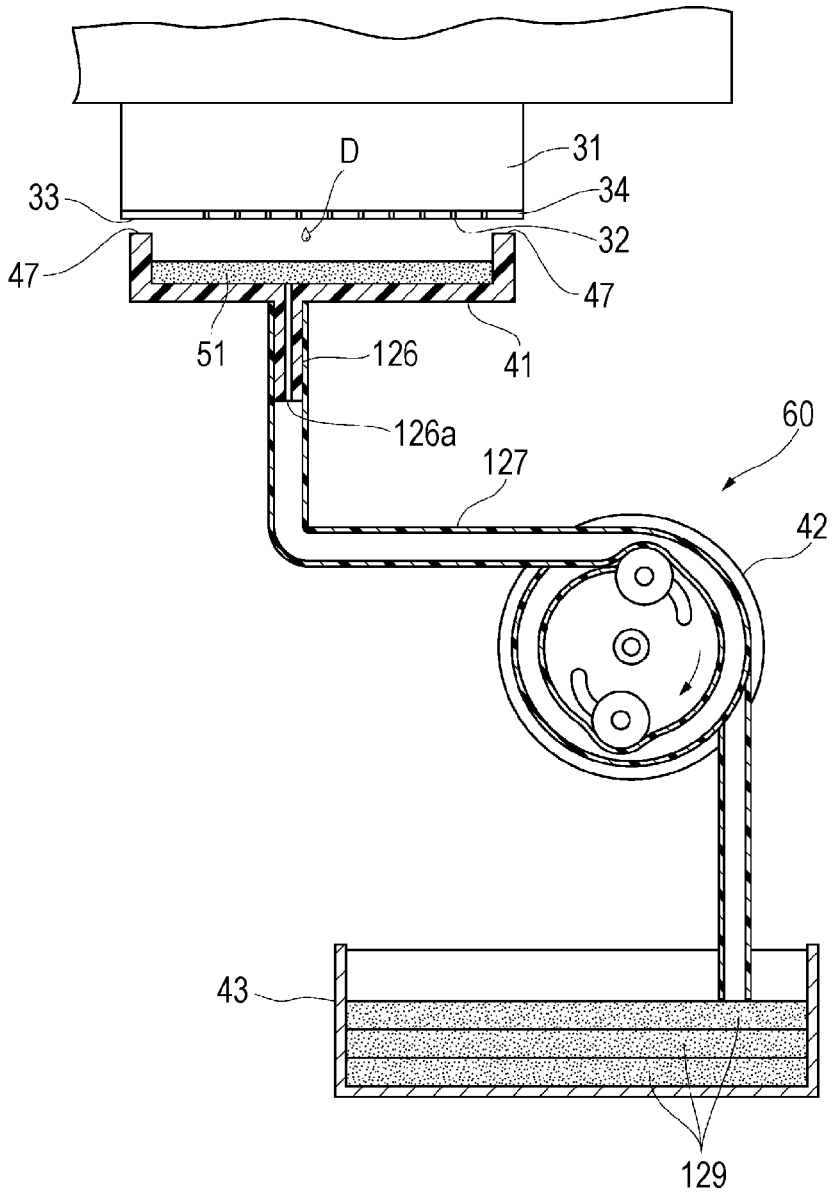
FIG. 3 is a schematic diagram which shows one example of a configuration of a cap member and a suctioning pump which is linked therewith which are provided in the ink jet recording apparatus according to one embodiment of the invention.

FIG. 1 is a block diagram which shows a configuration of a printer 1. FIG. 2 is a perspective diagram which shows a schematic configuration of the printer 1. FIG. 3 is a schematic diagram which shows a configuration of a cap member and a suctioning pump which is linked therewith which are provided in the printer 1.

The printer 1 of the present embodiment is an apparatus which forms an image on a recording medium P by discharging ink for ink jet recording (ink) toward the recording medium P. Here, it is possible for the printer 1 of the present embodiment to form an image using inks of various colors and examples thereof include forming an image using inks of four colors CMYK or forming a base which imparts an excellent concealing property to the recording medium P using a white ink. Furthermore, examples thereof also include overlaying clear ink on these CMYK or white inks and due to this, it is possible to increase glossiness.

The printer 1 has a transport unit 10, a carriage unit 20, a head unit 30, a cap lifting unit 50, a suction unit 60, a detector group 90, and a controller 100. The printer 1, which receives recording data from a computer 110 which is an external apparatus, controls each unit, that is, the transport unit 10, the carriage unit 20, the head unit 30, the cap lifting unit 50, and the suction unit 60 with the controller 100. The controller 100 controls each unit and prints an image on the recording medium P based on the recording data which is received from the computer 110. The status inside the printer 1 is monitored by the detector group 90 and the detector group 90 outputs the detection results to the controller 100. The controller 100 controls each unit based on the detection results which are output from the detector group 90.

The transport unit 10 is for transporting the recording medium P in a predetermined direction (referred to below as a "transport direction" or a "sub-scanning direction"). The transport unit 10 has a paper feeding roller (which is not shown in the diagram), a transport motor (not shown), a transport roller (not shown), a platen (not shown), and a paper discharging roller (not shown). The platen (which is not shown in the diagram) supports the recording medium P during recording and the recording medium P is fed on the platen by the driving of a paper feeding motor (not shown).

The carriage unit 20 is a moving mechanism which moves, that is, scans a head 31 (a recording head) in a direction (referred to below as a "moving direction" or a "main scanning direction") which intersects with the transport direction (the sub-scanning direction) described above while discharging ink to the recording medium P which is stopped in a recording region. The carriage unit 20 has a carriage 21, a carriage motor 22, and an ink cartridge 24. The carriage 21 is provided with the head 31 and the ink cartridge 24 in an inner section thereof and is linked with the carriage motor 22 via a timing belt 23. The ink cartridge 24 is mounted on the upper section of the printer 1 and the head 31 is provided on the lower surface of the ink cartridge 24. The ink cartridge 24 retains ink which is a liquid and supplies the ink from the ink cartridge 24 to the head 31. Then, the carriage 21 moves back and forth along a guide axis 25 due to the carriage motor 22 in a state of being supported by the guide axis 25 which intersects with the transport direction. The guide axis 25 supports the carriage 21 so as to be able to move back and forth in the axial line direction of the guide axis 25.

The head unit 30 is for discharging ink to the recording medium P. The head unit 30 is provided with the head 31 which receives a supply of ink from the ink cartridge 24 and discharges the ink from nozzles 32 which are formed on a nozzle forming surface 33 toward the recording medium P. The head 31 is provided with the nozzles 32 which discharge ink, a nozzle plate 34 which is provided on the lower surface of the head 31 and which has the nozzle forming surface 33 where the nozzles 32 are formed, a cavity (which is not shown in the diagram) which adds discharge driving force, a reservoir (not shown) which prevents the ink from flowing back, and piezoelectric elements (not shown) which form liquid droplets D of ink which are suitable for discharging. Since the head 31 is provided in the carriage 21 such that the nozzle forming surface 33 of the nozzle plate 34 which is formed of water repellent silicon opposes the recording medium P, when the carriage 21 moves in the moving direction, the head 31 also moves in the moving direction. Then, while the head 31 is moving in the moving direction, ink is discharged to the recording medium P. Due to this, a dot line is formed in the moving direction on the recording medium P. In this manner, by the head 31 discharging ink to the recording medium P, it is possible to simplify the recording apparatus. The nozzle forming surface 33 corresponds to the surface which opposes the recording medium P in the nozzle plate 34. It is possible to use, for example, a metal such as SUS and a resin such as polyimide as the material of the nozzle plate without being limited to silicon.

The cap lifting unit 50 is a mechanism which lifts a cap member 41 under the control of the controller 100.

The cap member 41 is a tray-shaped member of which the upper surface is open and is able to shield the nozzles 32 of the head 31 from the atmosphere by being adhered to the nozzle forming surface 33. Regarding the cap member 41, for example, an edge section 47 is made of an elastic member such as an elastomer in a housing which is formed of a modified polyphenylene ether (PPE) resin. In addition, it is possible to use a butyl based elastomer, an acrylonitrile-butadiene rubber (NBR) based elastomer, a silicon based elastomer, a urethane based elastomer, a butadiene based elastomer, a polyester based elastomer, a vinyl chloride based elastomer, an acrylic elastomer, an amide based elastomer, a styrene based elastomer, or the like as the elastomer of the edge section 47 in the cap member 41. The cap member 41 is provided with, for example, an ink absorbing material 51 which absorbs ink in the inner section of an opening section. The ink absorbing material 51 has high ink retention and is formed of, for example, a urethane foam, a sponge, a cloth or paper with ink absorbency, or the like. Due to this, it is possible to seal the nozzles which are arranged in the recording head while quickly absorbing ink from the head.

The suction unit 60 is provided with at least a suctioning pump 42 and a waste liquid tank 43. The suctioning pump 42 communicates with the inside of the cap of the cap member 41 and is able to generate negative pressure in the inside of the cap member 41 using the suctioning pump 42.

Description will be given of the structure of the suction unit in more detail using FIG. 3. An evacuation section 126 which evacuates ink which is accumulated in the cap member 41 is provided to project downward in a bottom wall of the cap member 41 and an evacuation path 126*a* is formed in the inside thereof. One end section of an evacuation tube (evacuation pipe) 127 formed of a flexible material or the like is connected with the evacuation section 126 and the other end section of the evacuation tube 127 is inserted inside the waste liquid tank 43. A waste ink absorbing material 129 formed of a porous member is accommodated in the waste liquid tank 43 and the ink recovered by the waste ink absorbing material 129 is collected.

For example, a tube pump type suctioning pump 42 is installed between the cap member 41 and the waste liquid tank 43. Negative pressure is generated in the cap member 41 by the suctioning force of the suctioning pump 42. In more detail, by driving the suctioning pump 42 in a state where the cap member 41 (to be more exact, the edge section 47 of the cap member 41) is adhered to the nozzle forming surface 33 of the head 31 and the nozzle forming surface 33 is covered with the cap member 41, and setting the space which is covered with the cap member 41 to a negative pressure state, ink is forcibly evacuated from each of the nozzles 32 toward the cap member 41. According to the suctioning operation, thickened ink or bubbles inside the nozzle 32 are forcibly evacuated.

In the present embodiment, the cap member 41, as described below, is used for a flushing operation which receives ink from the head 31 in a state of being separated from the head 31, a capping operation which covers a nozzle array by coming into contact with the head 31 in a left-to-stand state and protects the nozzles 32 by shielding the nozzles 32 from the atmosphere, and an operation of suctioning ink in the head 31 in a state of covering the nozzle array by coming into contact with the head 31.

Although not shown in the diagram, the printer 1 may be provided with a wiping unit which removes ink which is attached to the nozzle forming surface 33 by wiping the ink which is attached to the nozzle forming surface 33.

A linear type encoder (which is not shown in the diagram), a rotary type encoder (not shown), a paper detecting sensor (not shown), an optical sensor (not shown), and the like are included in the detector group 90. The linear type encoder detects the position of the carriage 21 in the moving direction. The rotary type encoder detects the rotation amount of the transport roller (which is not shown in the diagram). The paper detecting sensor (which is not shown in the diagram) detects a position of the leading end of a sheet of paper (the recording medium P) during paper feeding. The optical sensor (which is not shown in the diagram) detects whether or not the recording medium P is present using a light emitting section and a light receiving section which are attached to the carriage 21. Then, it is possible for the optical sensor (which is not shown in the diagram) to detect the positions of the end sections of the recording medium P while moving with the carriage 21 and to detect the width of the recording medium P. In addition, it is also possible for the optical sensor (which is not shown in the diagram) to detect a leading end (which is an end section on the transport direction downstream side and which is also referred to as an upper end) or a rear end (which is an end section on the transport direction upstream side and which is also referred to as a lower end) of the recording medium P according to the status.

The controller 100 is a control unit (a control section) for performing control of the printer 1. The controller 100 has an interface section 101, a CPU 102, a memory 103, and a unit control circuit 104. The interface section 101 sends and receives data between the computer 110, which is an external apparatus, and the printer 1. The CPU 102 is a central processing unit for performing control of the entire printer 1. The memory 103 is for securing a region in which a program of the CPU 102 is stored, a work region, and the like and has memory elements such as RAM and EEPROM. The CPU 102 controls each of the units via the unit control circuit 104 in accordance with the program which is stored in the memory 103.

2. Operation of Apparatus

The printer 1 shown in FIG. 1 to FIG. 3 is configured as above and detailed description will be given below of the operation of the printer 1.

Firstly, the recording medium P on a platen (which is not shown in the diagram) is transported in the transport direction by the transport unit 10 up to a position at which it is possible for the liquid droplets D (refer to FIG. 3) of ink which are discharged from the nozzles 32 of the head 31 to land, that is, a region where the ink which is discharged lands (is attached).

After that, the ink is discharged from the nozzles 32 of the head 31 toward the recording medium P by the head unit 30 and the ink lands on the target recording surface thereof. It is possible to use systems known in the art as the discharging method and it is possible to perform excellent recording when using a method for discharging liquid droplets using the vibration of piezoelectric elements (a recording method which uses a head which forms ink droplets by mechanical deformation of electrostriction elements) from among these systems. In addition, for example, by heating the target recording surface of the recording medium P up to a predetermined temperature, moisture or the like which is included in the ink which is discharged on the target recording surface of the recording medium P quickly evaporates and scatters, and thus a coating film is formed by a resin which is included in the ink.

On the other hand, in the nozzles 32 where discharging is not performed for a set period, in particular, in a portion of a nozzle opening 39, solidifying easily occurs due to the ink becoming dry. As a result, the nozzles 32 where discharging is not performed for a set period are easily clogged. The generation of clogging in the nozzles 32 leads to discharge defects.

Thus, it is possible to prevent the clogging in the nozzles 32 described above by performing a suctioning operation which removes ink in the cap member 41 by adhering the cap member 41 to the nozzle forming surface 33 or a flushing operation under the control of the controller 100.

Firstly, description will be given of the flushing operation (a flushing process). The flushing operation eliminates clogging in the nozzles 32 by discharging ink from the nozzles 32 of the head 31. The nozzles 32 of the head 31 are cleaned by moving the head 31 up to the position of the cap member 41 and carrying out non-recording discharging of the ink from the head 31 toward the cap member 41. Here, the "non-recording discharging" in the present specification refers to flushing and has a meaning of discharging toward the cap member 41 which is performed for the purpose of removing ink which is excessively dried which may be a cause of clogging rather than discharging toward the recording medium P which is performed for the purpose of forming an image.

Since an image is recorded by the discharging and fresh ink is constantly supplied by performing the evacuation of the ink, the solidification of the ink which may occur in the nozzles 32 where discharging is performed is on a comparatively small scale and, even in the nozzles 32 where discharging is not performed, the ink is not likely to be dried or solidified much immediately after finishing the movement for a single pass without printing. Therefore, by setting all of the nozzles 32 as a target, the head unit 30 is controlled such that the controller 100 performs the flushing operation at set time intervals, preferably when power is turned on and for each single pass recording operation, and more preferably for each single pass recording operation. That is, the head 31 (the carriage 21) is moved along the guide axis 25 to directly above the cap member 41 which is provided outside the platen (which is not shown in the diagram). Then, the nozzles 32 are cleaned by carrying out non-recording discharging of ink from the head 31 toward the cap member 41. It is sufficient if the amount of the non-recording discharge is enough to be able to evacuate the ink in the vicinity of the nozzles 32.

It is preferable that the operation of suctioning ink in the cap member be performed early on after the flushing operation. By suctioning ink which is present in the cap member 41 early on, it is possible to prevent the ink from overflowing to the edge section 47 of the cap member 41 and it is possible to suppress accumulation of the solid content of the ink on the edge section 47 of the cap member 41.

Next, description will be given of the suctioning operation. As shown in FIG. 2, the controller 100 moves the head 31 to a non-printing region 13 and positions the head 31 directly above the cap member 41. Then, the cap member 41 is lifted by the cap lifting unit 50, the edge section 47 of the cap member 41 is brought into contact (adhered) with the nozzle forming surface 33, and the nozzles 32 are sealed inside the cap member 41. Then, negative pressure is generated in the cap member 41 by the suctioning pump 42 and ink in the nozzles 32 is suctioned and evacuated to the inside of the cap member 41. According to the suctioning operation, in the same manner as the flushing operation, it is possible to evacuate the thickened ink in the nozzles 32 to the outside of the nozzles 32.

While the suctioning operation is able to strongly evacuate the thickened ink or bubbles inside the nozzles 32, the suctioning operation takes time compared to the wiping operation, and thus the suctioning operation is performed in a case where there is a great concern that recording defects will be generated such as when a recording process has not been performed for a long time, a case where there is a demand from a user when recording defects occur, or the like.

Next, description will be given of the capping operation. The capping operation is an operation which brings the cap member 41 into contact with the nozzle forming surface 33 and protects the nozzle forming surface by shielding the nozzle forming surface 33 from the atmosphere in a left-to-stand state where the recording operation of the printer 1 is stopped. By covering the nozzle forming surface 33 with the cap member 41 while the printer 1 is in a left-to-stand state, evaporation of a solvent such as moisture in the ink in the nozzles 32 is suppressed and the thickening of the ink is prevented. In addition, it is also possible to prevent the attachment of foreign matter such as dust to the nozzle forming surface 33.

Here, the "left-to-stand state" in the present specification refers to a state after a recording operation finishes based on a recording command which is output from the computer 110 with respect to the printer 1 in which a recording operation is not performed, until the next recording operation is performed. In detail, for example, after the recording operation finishes, the state where a power switch of the printer 1 is turned off and the printer does not conduct power is a left-to-stand state. In addition, even in a case where the power source is on, a state where a recording operation is not performed until a new printing command is issued with respect to the printer 1 after the recording operation finishes is a left-to-stand state. When the nozzles 32 are exposed to the outside air for a long time while in the left-to-stand state, there are problems such as that the moisture in the ink in the nozzles 32 evaporates, the ink thickens, and clogging is generated in the nozzles 32. In order to prevent the problems from occurring, the printer 1 is configured such that it is possible to perform the capping operation, suppress evaporation of moisture in the ink in the nozzles 32, and prevent the ink from thickening or prevent foreign matter from being attached to the nozzle forming surface 33.

In this manner, by the controller 100 appropriately and distinctly using the flushing operation, the suctioning operation, and the capping operation by detecting the usage state or clogging state of the nozzles 32, it is possible to prevent the ink from solidifying inside the nozzles 32 of the head 31 and the nozzles 32 from becoming clogged while securing high speed printing and moreover, it is possible to prevent missing dots from occurring in a portion of an image which is formed on the target recording surface of the recording medium P due to using the head 31 where clogging is generated.

As described above, the edge section 47 of the cap member 41 is a site where ink is easily attached and solidified. When ink solidifies on the edge section 47, there is a problem in that it is not possible to maintain negative pressure since, without sufficient adhesion between the edge section 47 of the cap member 41 and the nozzle plate 34 being possible, air flows in during the suctioning operation. In addition, there is a problem in that, without being able to effectively cap the nozzles in a left-to-stand state, the nozzles become dry. In order to solve the problems described above, the present embodiment adjusts the arrangement of the nozzles with respect to the cap member 41 and the solid content concentration of the ink.

Figure 4A:
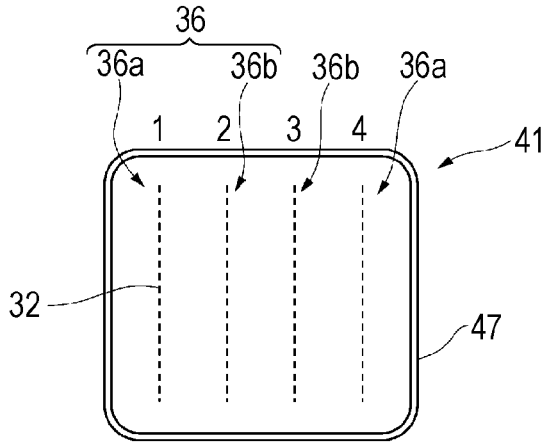
FIGS. 4A to 4C are schematic diagrams which represent an example of a nozzle forming surface in the ink jet recording apparatus according to one embodiment of the invention.
Figure 4B:
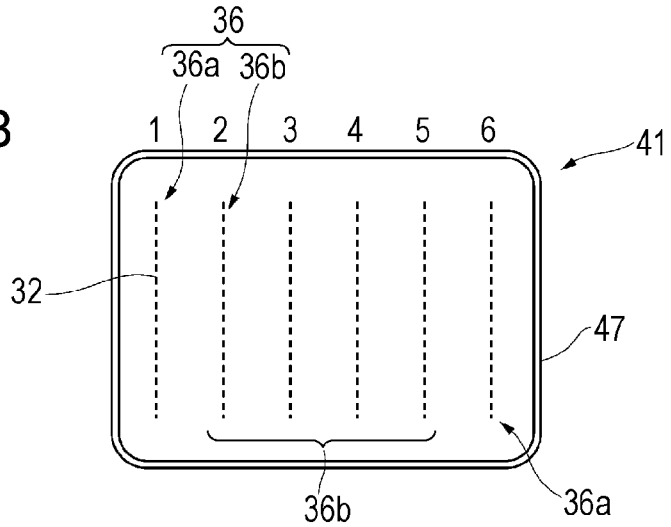
Figure 4C:
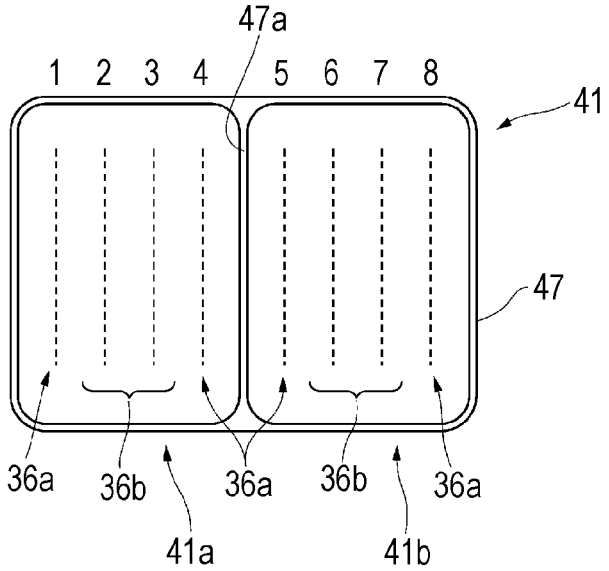

FIGS. 4A to 4C are diagrams which show an example of a configuration of the cap member 41 and the nozzle 32 in the present embodiment. FIGS. 4A to 4C show planar diagrams of the cap member 41 and also show an example of the arrangement of the nozzles 32 in a case of moving the head 31 to directly above the cap member 41.

FIGS. 4A and 4B show examples configured such that all of the nozzles 32 which are arranged in the head 31 are capped by a single cap member 41. FIG. 4A shows a cap member which caps four nozzle arrays 36 and the cap member 41 in FIG. 4B is a cap member which caps six nozzle arrays 36. The cap member 41 is provided with the edge section 47 which is provided so as to surround a plurality of the nozzle arrays 36. The nozzle arrays 36 are configured by a plurality of the nozzles 32, which discharge the same ink, being lined up. For example, the nozzle array 36 of the first line discharges the same ink throughout. Each of the nozzle arrays 36 extends in parallel with the transport direction of the recording medium and is arranged such that a plurality thereof line up in a direction which is orthogonal with the transport direction. Here, the configuration of the nozzle arrays is not limited thereto and the nozzle arrays may be arranged diagonally to the transport direction.

The present embodiment is configured such that out of a plurality of the nozzle arrays 36 which are accommodated in the single cap member 41, nozzle arrays 36*a* in the end side regions of the cap member 41 discharge ink with the lowest solid content concentration and nozzle arrays 36*b* in a central region of the cap member 41 discharge ink with the highest solid content concentration. In other words, the ink with the lowest solid content concentration is filled in the nozzle arrays 36*a* in the end side regions of the cap member 41 and the ink with the highest solid content concentration is filled in the nozzle arrays 36*b* in the central region of the cap member 41.

In the present specification, "nozzle arrays in the end side regions of the cap member" refers to the nozzle arrays which are the closest to the edge section 47 of the cap member 41. In the case of FIG. 4A, the nozzle arrays 36 in the first line and the fourth line correspond to the nozzle arrays in the end side region of the cap member and in the case of FIG. 4B, the nozzle arrays 36 in the first line and the sixth line correspond to the nozzle arrays in the end side regions of the cap member.

In the present specification, "nozzle arrays in the central region of the cap member" refers to nozzle arrays other than the "nozzle arrays in the end side regions of the cap member" out of the nozzle arrays which are capped by the same cap member. Accordingly, in the case of the nozzle arrangement shown in FIG. 4A, the nozzle arrays 36 in the second and third lines correspond to the "nozzle arrays in the central region of the cap member" and in the case of the nozzle arrangement shown in FIG. 4B, the nozzle arrays 36 in the second to fifth lines correspond to the "nozzle arrays in the central region of the cap member".

In the present specification, the "solid content" is a component which is not soluble in the main solvent of the ink and is a water-insoluble component in a case of a water based ink. Regarding measuring the solid content, in a case of filtering with a membrane filter, the component which is left on the membrane filter may be extracted. The hole diameter of the filter may be selected by matching with the particle diameter of the component in the ink; however, in an ink jet ink, a range from 100 nm to 1 μm is generally selected. For pigment based ink, a pigment or a resin emulsion is one example which corresponds to the solid content.

Out of the plurality of the nozzle arrays 36 which are accommodated in the single cap member 41, the ink which is discharged from the nozzle arrays 36*a* in the end side regions of the cap member 41 will be attached to the edge section 47 of the cap member 41 and there is a high possibility that the solid content of the ink will be accumulated thereon. By configuring the present embodiment such that the ink which is discharged from the nozzle arrays 36*a* in the end side regions of the cap member 41 is the ink with the lowest solid content concentration, even in a case where the ink which is discharged from the nozzle arrays 36*a* is attached to the edge section 47 of the cap member 41, it is possible to suppress the amount of the solid content which is accumulated on the edge section 47 of the cap member 41 since the solid content concentration of ink which is discharged from the nozzle arrays 36 is relatively the lowest. In addition, by configuring the present embodiment such that the nozzle arrays 36*b* in a central region of the cap member 41 discharge ink with the highest solid content concentration, since it is possible to separate the edge section 47 of the cap member 41 and the nozzle arrays 36*b* and it is possible to reduce the possibility that ink which is discharged from the nozzle arrays 36*b* will be directly attached to the edge section 47 of the cap member 41, the accumulation of ink with a high solid content concentration on the edge section 47 of the cap member 41 is suppressed.

As shown in FIGS. 4A and 4B, it is preferable that the two nozzle arrays 36*a* and 36*a* in the end side regions of the cap member 41 be arranged so as to discharge two types of ink with the lowest solid content concentrations. Due to this, it is possible to suppress the amount of the solid content which is accumulated on both sides of the edge section 47 of the cap member 41.

More preferably, the solid content concentration of the ink which fills the nozzle arrays 36*a* and 36*a* in the end side regions of the cap member 41 is 4 mass % or less. By setting the absolute value of the solid content concentration of the ink which fills the nozzle arrays 36*a* and 36*a* in the end side regions of the cap member 41 to be low, it is possible to suppress the amount of the solid content which is accumulated on the edge section 47 of the cap member 41.

For example, each of the nozzles 32 which configure the nozzle arrays 36 discharges liquid droplets of ink which are 4 pL or less. The nozzles 32 which discharge such minute liquid droplets of ink have a small nozzle diameter and nozzle clogging is easily generated. According to the present embodiment, even in the nozzles 32 which discharge liquid droplets of ink which are 4 pL or less where it is extremely difficult to control discharging, the nozzle clogging is suppressed by appropriately performing the suctioning operation, the flushing operation, and the capping operation described above, and as a result, it is possible to suppress discharge defects in the ink. Here, "discharge liquid droplets of ink which are 4 pL or less" does not have a meaning that all of the liquid droplets of ink which are discharged from the nozzle are 4 pL or less, but has a meaning that liquid droplets with the size of a minute amount of 4 pL or less are included in the liquid droplet group which is discharged.

Description will be given of the composition of the ink below; however, it is preferable that the ink in the present embodiment include glycerin in order to suppress the drying of the ink. Then, preferably, all of the inks which fill in the plurality of the nozzle arrays 36 which are capped by the single cap member 41 contain glycerin and it is preferable to adjust the inks such that a difference between the ink where the glycerin content is the highest and the ink where the glycerin content is the lowest is 4% or less. When ink contains a solvent with a high boiling point such as glycerin, the drying of the ink is suppressed. On the other hand, glycerin has high hygroscopicity. Therefore, in a state of capping the nozzle forming surface 33 of the head 31 with the cap member 41, in a case where the nozzle 32 which discharges ink with a remarkably low glycerin content is present, a phenomenon may occur where a solvent moves from a nozzle filled with ink with a high glycerin content to a nozzle filled with ink with a low glycerin content. As a result, the viscosity of the ink changes and the ink discharge property is unstable. According to the present embodiment, it is possible to prevent the solvent from moving between the inks.

In a case where there is a combination of two or more inks for which the difference in the glycerin content exceeds 4%, it is preferable that the cap member be divided into a plurality of cap members and that each of the two or more inks for which the difference in the glycerin content exceeds 4% fill nozzles in regions of different cap members. FIG. 4C shows an example where the cap member is divided into two cap members 41*a* and 41*b*.

As shown in FIG. 4C, the cap member 41*a* is provided with the edge section 47 which is provided so as to surround, for example, the nozzle arrays 36 of lines 1 to 4 and the cap member 41*b* is provided with the edge section 47 which is provided so as to surround, for example, the nozzle arrays 36 of lines 5 to 8. The cap member 41*a* and the cap member 41*b* are formed integrally. In other words, by providing a partition section 47*a* in the single cap member, the cap member is divided into the two cap members (cap sections) 41*a* and 41*b*. Here, the two cap members 41*a* and 41*b* may be configured to be divided. In addition, the cap member may be divided into three or more cap members.

In a case of the divided cap shown in FIG. 4C, the nozzle arrays 36 in the first, fourth, fifth, and eight lines correspond to the "nozzle arrays in the end side regions of the cap member". In addition, the nozzle arrays 36 in the second, third, sixth, and seventh lines correspond to the "nozzle arrays in the central region of the cap member".

According to the configuration example shown in FIG. 4C, it is possible to fill any of the nozzle arrays 36 in the first to fourth lines which are sealed by the cap member 41*a* with one of the two inks for which the difference in the glycerin content exceeds 4% and to fill any of the nozzle arrays 36 in the fifth to eighth lines which are sealed by the cap member 41*b* with the other ink. For this reason, it is possible to arrange the two nozzle arrays which discharge ink for which the difference in the glycerin content exceeds 4% in regions of the cap members which are different from each other. Due to this, even in a case where the head 31 is provided with two nozzle arrays which discharge ink for which the difference in the glycerin content exceeds 4%, since it is possible to suppress the difference in the glycerin content in the plurality of nozzle arrays which are accommodated in one cap member to 4% or less, it is possible to prevent the solvent from moving between inks in a state of being capped with the cap member.

Ink Jet Recording Method

The present embodiment is an ink jet recording method which discharges ink to a recording medium using the ink jet recording apparatus described above. As described above, since it is possible to suppress the drying of ink nozzles and since it is possible to suppress nozzle clogging or changes in viscosity of the ink, it is possible to provide an ink jet recording method with increased ink discharge stability.

Recording Medium

The recording medium to which the invention is applied is not limited and it is possible to use various types of recording media such as plain paper, glossy paper, fabric, and recording media having non-absorbency or low absorbency to ink. The ink jet recording apparatus according to the present embodiment is suitable for ink jet recording which uses, in particular, a recording medium or fabric having non-absorbency or low absorbency to ink. In detail, as will be described below, the ink which is used in the present embodiment is suitable for ink jet recording on a recording medium or fabric having non-absorbency or low absorbency to ink because of the composition thereof.

In the present specification, a "recording medium having non-absorbency or low absorbency to ink" indicates a "recording medium where the amount of water absorption from the beginning of contact to 30 $msec^{1/2}$ is 10 $mL/m^2$ or less according to the Bristow method". The Bristow method is the most widespread method for measuring the amount of liquid absorption in a short time and is also adopted by Japan Technical Association of Pulp and Paper Industry (JAPAN TAPPI). The details of the testing method are described in the standard No. 51 "Paper and Cardboard-Liquid Absorbency Test Method-Bristow Method" of the "JAPAN TAPPI Paper and Pulp Test Method 2000 Edition".

Recording media having non-absorbency to ink are not limited to the following; however, examples thereof include a plastic film where a surface treatment for ink jet recording is not carried out (that is, an ink absorbing layer is not formed), a recording medium where plastic coats a base material such as paper, and a recording medium to which a plastic film is bonded. The plastic is not particularly limited; however, examples thereof include polyvinyl chloride, polyethylene terephthalate, polycarbonate, polystyrene, polyurethane, polyethylene, and polypropylene. Examples of a recording medium having low absorbency to ink include actual printing paper such as art paper, coated paper, and mat paper.

Fabric is not limited to the following; however, examples thereof include natural fibers or synthetic fibers such as silk, cotton, wool, nylon, polyester, and rayon.

Ink Jet Recording Ink

Ink jet recording ink (ink) is not particularly limited as long as the ink is favorably used for the ink jet recording apparatus of the present embodiment; however, description will be given below of additives (components) which are included or which may be included in the ink of the present embodiment.

1. Coloring Material

The ink of the present embodiment may include a coloring material. The coloring material described above is selected from pigments and dyes.

1-1. Pigment

In the present embodiment, it is possible to improve the light resistance of the ink by using a pigment as a coloring material. It is possible to use any inorganic pigments or organic pigments as the pigment.

The inorganic pigments are not particularly limited; however, examples thereof include carbon black, iron oxide, titanium oxide, and silica oxide.

The carbon black described above is not particularly limited; however, examples thereof include furnace black, lamp black, acetylene black, and channel black (C.I. Pigment Black 7). In addition, examples of commercial products of carbon black include No. 2300, 900, MCF88, No. 20B, No. 33, No. 40, No. 45, No. 52, MA7, MA8, MA100, and No. 2200B (the above are all product names, manufactured by Mitsubishi Chemical Corp.), Color Black FW1, FW2, FW2V, FW18, FW200, S150, S160, S170, Pretex 35, U, V, 140U, Special Black 6, 5, 4A, 4, and 250 (the above are all product names, manufactured by Degussa AG), Conductex SC, Raven 1255, 5750, 5250, 5000, 3500, 1255, and 700 (the above are all product names, manufactured by Columbian Carbon Japan Ltd.), Regal 400R, 330R, 660R, Moglu L, Monarch 700, 800, 880, 900, 1000, 1100, 1300, 1400, and Elftex 12 (the above are all product names, manufactured by Cabot Corp.).

The inorganic pigment may be used as one type individually or may be used by combining two or more types.

An organic pigment is not particularly limited; however, examples thereof include a quinacridone based pigment, a quinacridone quinone based pigment, a dioxazine based pigment, a phthalocyanine based pigment, an anthrapyrimidine based pigment, an anthanthrone based pigment, an indanthrone based pigment, a flavanthrone based pigment, a perylene based pigment, a diketopyrrolopyrrole based pigment, a perinone based pigment, a quinophthalone based pigment, an anthraquinone based pigment, a thioindigo based pigment, a benzimidazolone based pigment, an isoindolinone based pigment, an azomethine based pigment, and an azo based pigment. Specific examples of organic pigments include the following.

Examples of pigments which are used for cyan ink include C.I. Pigment Blue 1, 2, 3, 15, 15:1, 15:2, 15:3, 15:4, 15:6, 15:34, 16, 18, 22, 60, 65, 66, C.I. Vat Blue 4, and 60. Among these, at least either of C.I. Pigment Blue 15:3 and 15:4 is preferable.

Examples of pigments which are used for magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48:2, 48:4, 57, 57:1, 88, 112, 114, 122, 123, 144, 146, 149, 150, 166, 168, 170, 171, 175, 176, 177, 178, 179, 184, 185, 187, 202, 209, 219, 224, 245, 254, 264, C.I. Pigment Violet 19, 23, 32, 33, 36, 38, 43, and 50. Among these, one type or more which is selected from a group formed of C.I. Pigment Red 122, C.I. Pigment Red 202, and C.I. Pigment Violet 19 is preferable.

Examples of a pigment which is used for yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among these, one type or more which is selected from a group formed of C.I. Pigment Yellow 74, 155, and 213 is preferable.

Here, examples of pigments which are used for inks of colors other than those described above such as green ink or orange ink include pigments known in the art.

Since it is possible to suppress the clogging in the nozzles and the discharge stability is more favorable, it is preferable that the average particle diameter of the pigment be 250 nm or less.

Here, unless otherwise specified, the average particle diameter in the present specification is based on volume. As the measuring method, for example, it is possible to carry out the measuring using a particle size distribution measuring apparatus using a laser diffraction scattering method as a measuring principle. Examples of the particle size distribution measuring apparatus include a particle size distribution meter using a dynamic light scattering method as a measuring principle (for example, a Microtrac UPA manufactured by Nikkiso Co., Ltd.).

1-2. Dye

In the present embodiment, it is possible to use a dye as the coloring material. The dye is not particularly limited and it is possible to use an acid dye, a direct dye, a reactive dye, or a basic dye.

It is preferable that the content of the coloring material be 0.4 to 12 mass % with respect to the total mass of ink (100 mass %) and more preferably 2 to 5 mass %.

2. Resin

It is preferable that the ink in the present embodiment contain a resin. Due to the ink containing a resin, a resin film is formed on the recording medium and, as a result, a main effect of making the scratch resistance of an image favorable is exhibited by sufficiently fixing the ink on the recording medium.

The resin may be any of anionic, nonionic, or cationic. Among these, nonionic or anionic is preferable from the point of view that the material is suitable for a head.

A resin may be used as one type individually or may be used by combining two or more types.

In addition, examples of resins which may be contained in the ink described above include a resin dispersant, a resin emulsion, a wax, and the like.

2-1. Resin Dispersant

When the pigment described above is contained in the ink of the present embodiment, the ink may include a resin dispersant in order to be able to stably disperse and hold the pigment in the water. By the ink described above including a pigment (referred to below as a "resin dispersion pigment") which is dispersed using a resin dispersant such as a water-soluble resin or a water-dispersible resin, when the ink is attached to the recording medium, it is possible to achieve a favorable adhesion at least between the recording medium and the ink, between the solids in the ink, or between both. Among the resin dispersants, a water-soluble resin is preferable since the dispersion stability is excellent.

A resin dispersant may be used as one type individually or may be used by combining two or more types.

Among the resins, the addition amount of the resin dispersant with respect to the pigment is preferably 1 parts by mass to 100 parts by mass with respect to 100 parts by mass of the pigment and more preferably 5 parts by mass to 50 parts by mass. When the addition amount is within the range described above, it is possible to secure a favorable dispersion stability for the pigment in water.

2-2. Resin Emulsion

The ink of the present embodiment may include a resin emulsion. The resin emulsion exhibits an effect of making the adhesiveness and scratch resistance of an image favorable by sufficiently fixing the ink on a recording medium by forming a resin film.

In addition, the resin emulsion which functions as a binder is contained in the ink in an emulsion state. By containing the resin which functions as a binder in the ink in an emulsion state, the viscosity of the ink is easily adjusted to the correct range in an ink jet recording system and the storage stability and discharge stability of the ink are excellent.

A resin emulsion is not limited to the below; however, examples thereof include homopolymers or copolymers of (meth)acrylic acid, (meth)acrylic ester, acrylonitrile, cyanoacrylate, acrylamide, olefin, styrene, vinyl acetate, vinyl chloride, vinyl alcohol, vinyl ether, vinylpyrrolidone, vinylpyridine, vinylcarbazole, vinylimidazole, and vinylidene chloride, fluorocarbon resins, and natural resins. Among these, at least any of a (meth)acrylic based resin and a styrene-(meth)acrylic copolymer based resin is preferable, at least any of an acrylic based resin and a styrene-acrylic copolymer based resin is more preferable, and a styrene-acrylic copolymer based resin is even more preferable. Here, the copolymers described above may take any form of a random copolymer, a block copolymer, an alternating copolymer, or a graft copolymer.

A commercial product may be used for the resin emulsion and the resin emulsion may be prepared using an emulsion polymerization method or the like as follows. Examples of a method which obtains a thermoplastic resin in the ink in an emulsion state include carrying out emulsion polymerization on a monomer of the water-soluble resin described above in water in which a polymerization catalyst and an emulsifier are present. Polymerization initiators, emulsifiers, and molecular weight adjusting agents which are used at the time of emulsion polymerization are able to be used according to methods known in the art.

In order to make the storage stability and discharge stability of ink more favorable, the average particle diameter of the resin emulsion is preferably in a range of 5 nm to 400 nm and more preferably, 20 nm to 300 nm.

A resin emulsion may be used as one type individually or may be used by combining two or more types.

Among the resins, it is preferable that the content of the resin emulsion be in a range of 0.5 to 7 mass % with respect to the total mass of the ink (100 mass %). Since it is possible to make the solid content concentration low when the content is within the range described above, it is possible to make the discharge stability more favorable.

3. Surfactant

The ink of the present embodiment may include a surfactant. The surfactant is not particularly limited; however, examples thereof include an acetylene glycol based surfactant, a fluorine based surfactant, and a silicone based surfactant. By an ink composition including these surfactants, the storage stability and discharge stability of ink are more favorable and high speed printing is possible.

The acetylene glycol based surfactant is not particularly limited; however, one type or more which is selected from 2,4,7,9-tetramethyl-5-decyne-4,7-diol and an alkylene oxide additive of 2,4,7,9-tetramethyl-5-decyne-4,7-diol, and 2,4-dimethyl-5-decyne-4-ol and an alkylene oxide additive of 2,4-dimethyl-5-decyne-4-ol is preferable. Commercial products of the acetylene glycol based surfactant are not particularly limited; however, examples thereof include Olefin 104 series or E series such as Olefin E1010 (manufactured by Air Products Japan, Inc.), Surfynol 104, 465, and 61 (manufactured by Nissin Chemical Industry Co., Ltd.) and the like. An acetylene glycol based surfactant may be used as one type individually or two or more types may be used together.

The fluorine based surfactant is not particularly limited; however, examples thereof include perfluoroalkyl sulfonate, perfluoroalkyl carboxylate, perfluoroalkyl phosphoric acid ester, a perfluoroalkyl ethylene oxide additive, perfluoroalkyl betaine, and a perfluoroalkyl amine oxide compound. A commercial product of a fluorine based surfactant is not particularly limited; however, examples thereof include S-144 and S-145 (manufactured by Asahi Glass Co., Ltd.), FC-170C, FC-430, and Fluorad-FC4430 (manufactured by Sumitomo 3M Inc.), FSO, FSO-100, FSN, FSN-100, and FS-300 (manufactured by Dupont Corp.), FT-250 and 251 (manufactured by Neos Co., Ltd.), and the like. The fluorine based surfactant may be used as one type individually or two or more types may be used together.

Examples of the silicone based surfactant include a polysiloxane based compound, a polyether-modified organosiloxane, and the like. Commercial products of the silicone based surfactant are not particularly limited; however, in detail, BYK-306, BYK-307, BYK-333, BYK-341, BYK-345, BYK-346, BYK-347, BYK-348, and BYK-349 (the above are all product names, manufactured by BYK-Chemie Japan Corp.), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (the above are all product names, manufactured by Shin-Etsu Chemical Co., Ltd.), and the like.

The surfactant may be used as one type individually or may be used by mixing two or more types.

Since the storage stability and discharge stability of ink are more favorable, it is preferable that the content of the surfactant be in a range of 0.1 mass % or more to 3 mass % or less with respect to the total mass of the ink (100 mass %).

4. Water

The ink of the present embodiment may contain water. In particular, in a case where the ink is water based ink, the water is a medium which is the main part of the ink and is a component which evaporates and scatters when the recording medium is heated during ink jet recording.

Examples of the water include pure water and extra pure water such as ion-exchanged water, excess filtered water, Milli Q water, and distilled water where ionic impurities are removed as much as possible. In addition, when using water which is sterilized by ultraviolet irradiation, hydrogen peroxide addition, or the like, it is possible to prevent the generation of mold or bacteria in a case of storing the pigment dispersant and ink which uses the pigment dispersant for long periods.

The content of the water is not particularly limited and may be appropriately determined as necessary.

5. Organic Solvent

The ink of the present embodiment may include a volatile water-soluble organic solvent. However, as described above, it is preferable that the ink of the present embodiment include glycerin which is one type of organic solvent with a high boiling point (the boiling point under 1 atm is 290° C.). The glycerin content is preferably 1 to 25 mass % with respect to the total amount of ink 100 mass % and more preferably 5 to 15 mass %. By the content of the glycerin organic solvent being within the range described above, it is possible to prevent the volatile component in the ink from volatilizing and it is possible to reliably moisturize the ink and improve storage stability of the ink.

Other organic solvents are not limited to the following; however, examples thereof include alcohols or glycols such as ethylene glycol, diethylene glycol, triethylene glycol, propylene glycol, dipropylene glycol, 1,3-propanediol, 1,2-butanediol, 1,2-pentanediol, 1,2-hexanediol, 1,4-butanediol, 1,5-pentanediol, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol mono methyl ether, propylene glycol mono ethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, methanol, ethanol, n-propyl alcohol, iso-propyl alcohol, n-butanol, 2-butanol, tert-butanol, iso-butanol, n-pentanol, 2-pentanol, 3-pentanol, and tert-pentanol; N,N-dimethyl formamide, N,N-dimethyl acetamide, 2-pyrrolidone, N-methyl-2-pyrrolidone, 2-oxazolidone, 1,3-dimethyl-2-imidazolidinone, dimethyl sulfoxide, sulfolane, and 1,1,3,3-tetramethylurea.

The organic solvent may be used as one type individually or may be used by combining two or more types. The content of the organic solvent is not particularly limited and may be appropriately determined as necessary.

6. pH Adjusting Agent

The ink of the present embodiment may include pH adjusting agents. Examples of pH adjusting agents include inorganic alkalis such as sodium hydroxide and potassium hydroxide, ammonia, diethanolamine, triethanolamine, triisopropanolamine, morpholine, potassium dihydrogenphosphate, and disodium hydrogenphosphate.

pH adjusting agents may be used as one type individually or may be used by combining two or more types. The content of the pH adjusting agents is not particularly limited and may be appropriately determined as necessary.

7. Other Components

In addition to the components described above, it is also possible to appropriately add various types of additives such as a dissolution auxiliary agent, a viscosity adjusting agent, an antioxidant, a preservative, an antifungal agent, an antifoaming agent, and a corrosion inhibitor to the ink of the present embodiment.

8. Method for Manufacturing Ink

It is possible to obtain the ink of the present embodiment by mixing the components (materials) described above in an arbitrary order, performing filtering or the like as necessary, and removing impurities. Here, for ease of handling, it is preferable that the pigment be mixed after being prepared in a state of being evenly dispersed in a solvent beforehand.

A method which carries out stirring and mixing after sequentially adding materials to a container which is provided with a stirring apparatus such as a mechanical stirrer or a magnetic stirrer is favorably used as the method for mixing each material. As a filtering method, for example, it is possible to perform centrifugal filtration, filter filtration, and the like as necessary.

Example 1

Below, detailed description will be given of the invention using Examples; however, the invention is not limited thereto.

1. Materials for Ink

The main materials for preparing the inks which are used in the Examples and the Comparative Examples described below are as follows.

[Pigment] C.I. Pigment Blue 15:3 (PB 15:3), C.I. Pigment Violet 19 (PV 19), C.I. Pigment Yellow 74 (PY 74), Carbon Black (CB)

[Resin Emulsion] styrene acrylic based resin (Tg 40° C., acid value 100, weight average molecular weight 20000)

[Organic Solvent] glycerin, 1,2-hexthanediol, 2-pyrrolidone

[Surfactant] Surfynol 104, Olefin E1010

[pH adjusting agents] triethanolamine

[Water]

2. Preparing Ink Composition

Each ink composition is obtained by mixing each of the materials in the compositions (mass %) shown in Table 1 below and carrying out sufficient stirring.

TABLE 1

| | Cyan | Light Cyan | Magenta | Light Magenta | Yellow | Black | Gray | Light Gray |
|---|---|---|---|---|---|---|---|---|
| PB15:3 | 2.5 | 0.5 | | | | | | |
| PV19 | | | 3.5 | 0.8 | | | | |
| PY74 | | | | | 3 | | | |
| CB | | | | | | 5 | 1 | 0.3 |
| Styrene acrylic based resin | 0.6 | 2 | 0.8 | 2 | 0.6 | 1 | 2 | 3 |
| Glycerine | 12 | 10 | 13 | 11 | 12 | 15 | 12 | 12 |
| 2-pyrolidone | 4 | 4 | 4 | 4 | 4 | 4 | 4 | 4 |
| 1,2-hexane diol | 3 | 3 | 3 | 3 | 3 | 3 | 3 | 3 |
| Surfynol 104 | 0.2 | 0.2 | 0.2 | 0.2 | 0.2 | 0.2 | 0.2 | 0.2 |
| Olefin E1010 | 0.4 | 0.4 | 0.4 | 0.4 | 0.4 | 0.4 | 0.4 | 0.4 |
| Triethanolamine | 0.2 | 0.2 | 0.2 | 0.2 | 0.2 | 0.2 | 0.2 | 0.2 |
| Water | Remainder | Remainder | Remainder | Remainder | Remainder | Remainder | Remainder | Remainder |
| Total solid content | 3.1 | 2.5 | 4.3 | 2.8 | 3.6 | 6 | 3 | 3.3 |

3. Configuration of Cap Member

Regarding an ink set of four colors of CMYK (C is cyan ink, M is magenta ink, Y is yellow ink, and K is black ink), an ink set of six colors of CMYLKLmLc (Lm is light magenta ink and Lc is light cyan ink), and an ink set of eight colors of CMYKLmLcGLg (G is gray ink and Lg is light gray ink), the Examples and the Comparative Examples are prepared by changing the arrangement of ink and the configuration of the cap as shown below.

3-1. Single Cap (Four Line Sealing)

Using the cap member 41 shown in FIG. 4A, the CMYK ink set in Example 1 and Comparative Example 1 was made by filling the nozzles 32 in the first line to the fourth line with ink as shown in Table 2 below.

TABLE 2

| Type | First Line End region | Second Line Central region | Third Line Central region | Fourth Line End region |
|---|---|---|---|---|
| Example 1 | Cyan | Black | Magenta | Yellow |
| Comparative Example 1 | Black | Cyan | Yellow | Magenta |

As shown in Table 2, in Example 1, in the CMYK ink set, cyan ink and yellow ink with the lowest solid content concentration fill the nozzles 32 in the first and fourth lines in end side regions of the cap member 41 and black ink and magenta ink with the highest solid content concentration fill the nozzles 32 in the second and third lines in a central region of the cap member 41. With respect to this, in Comparative Example 1, the black ink with the highest solid content concentration fills the nozzle 32 in the first line in an end side region of the cap member 41.

3-2. Single Cap (Six Line Sealing)

Using the cap member 41 shown in FIG. 4B, the CMYKLmLc ink set in Examples 2 and 3 and Comparative Examples 2 and 3 was made by filling the nozzles 32 in the first line to the sixth line with ink as shown in Table 3 below.

TABLE 3

| Type | First Line End region | Second Line Central region | Third Line Central region | Fourth Line Central region | Fifth Line Central region | Sixth Line End region |
|---|---|---|---|---|---|---|
| Example 2 | Light cyan | Cyan | Black | Magenta | Yellow | Light magenta |
| Example 3 | Light cyan | Cyan | Black | Yellow | Magenta | Light magenta |
| Comparative Example 2 | Yellow | Light magenta | Light cyan | Magenta | Cyan | Black |
| Comparative Example 3 | Magenta | Cyan | Light cyan | Light magenta | Yellow | Black |

As shown in Table 3, the arrangement of the ink for Example 2 is determined in accordance with the solid content concentration of ink. That is, ink where the solid content concentration of the ink is the lowest is arranged in an end side region of the cap member 41 and ink is arranged such that the solid content concentration of the ink increases toward the central region of the cap member 41.

Example 3 changes the arrangement of magenta ink and yellow ink in the arrangements of ink in Example 2 such that the same colors are adjacent.

Comparative Example 2 arranges the inks in order of brightness and the ink with the highest brightness is arranged in the first line and the ink with the lowest brightness is arranged in the sixth line.

Comparative Example 3 arranges the ink where the solid content concentration of the ink is the highest in an end side region of the cap member 41 and the inks are arranged such that the solid content concentration of ink decreases toward the central region of the cap member 41.

3-3. Dividing Cap (Sealing Every Four Lines)

Using the dividing cap shown in FIG. 4C, the CMYKLmLcGLg ink set in Examples 4 and 5 and Comparative Examples 4 and 5 were made by filling the nozzles 32 in the first line to the eighth line with ink as shown in Table 4 below.

TABLE 4

| Type | First Line End region | Second Line Central region | Third Line Central region | Fourth Line End region | Fifth Line End region | Sixth Line Central region | Seventh Line Central region | Eighth Line End region |
|---|---|---|---|---|---|---|---|---|
| Example 4 | Light cyan | Cyan | Magenta | Light magenta | Light gray | Yellow | Black | Gray |
| Example 5 | Light cyan | Cyan | Magenta | Gray | Light gray | Yellow | Black | Light magenta |
| Comparative Example 4 | Yellow | Light magenta | Light cyan | Light gray | Gray | Magenta | Cyan | Black |
| Comparative Example 5 | Magenta | Light magenta | Light cyan | Cyan | Black | Light gray | Gray | Yellow |

As shown in Table 4, in Example 5, the two inks with the lowest solid content concentrations fill the nozzles 32 in end side regions of each of the cap members 41*a* and 41*b* and the two inks with the highest solid content concentrations fill the nozzles 32 in a central region of each of the cap members 41*a* and 41*b*.

Example 4 changes the arrangement of light magenta ink and magenta ink in Example 5 such that the same colors are adjacent.

Comparative Example 4 arranges the inks in order of brightness and the ink with the highest brightness is arranged in the first line and the ink with the lowest brightness is arranged in the sixth line.

Comparative Example 5 arranges the inks where the solid content concentration of ink is the highest in end side regions of the cap member 41.

4. Ink Jet Recording

A modified printer PX-5500 (manufactured by Seiko Epson Corp.) was used. As described above, the main modified portion is the point that the arrangement of the ink set is changed. An ink jet recording apparatus which includes the ink set in Examples 1 to 5 and Comparative Examples 1 to 5 was continuously used and clogging in the nozzles was evaluated.

It was confirmed that, compared to the ink jet recording apparatus in the Comparative Examples, the ink jet recording apparatus of the present embodiment is able to prevent generation of capping defects due to ink solidifying on the edge section of the cap member 41 and is excellent for preventing nozzle clogging. In addition, it was confirmed that it is possible to improve the discharge stability of the ink along with preventing the clogging of the nozzles.

The entire disclosure of Japanese Patent Application No. 2014-028913, filed Feb. 18, 2014 is expressly incorporated by reference herein.

What is claimed is:

1. An ink jet recording apparatus comprising:

a recording head in which nozzle arrays are configured by lining up a plurality of nozzles which discharge identical inks and the nozzle arrays are arranged in a plurality of lines, and which discharges a plurality of types of ink; and at least one cap member which covers the plurality of the nozzle arrays in a left-to-stand state, wherein the cap member is used for an operation of suctioning ink in the recording head in a state where the plurality of the nozzle arrays are covered, a flushing operation which receives ink from the recording head in a state of being separated from the recording head, and a capping operation which protects the nozzles by covering the plurality of the nozzle arrays in a left-to-stand state, and out of a plurality of nozzle arrays which are accommodated in one cap member in a capping operation, a nozzle array in an end side region of the cap member discharges ink with the lowest solid content concentration and a nozzle array in a central region of the cap member discharges ink with the highest solid content concentration.

2. The ink jet recording apparatus according to claim 1, wherein two nozzle arrays in the end side region of the cap member discharge two types of inks with the lowest solid content concentration.

3. An ink jet recording method which discharges ink with respect to a recording medium using the ink jet recording apparatus according to claim 2.

4. The ink jet recording apparatus according to claim 1, wherein the solid content concentration of ink which is filled in a nozzle array in the end side region of the cap member is 4 mass % or less.

5. An ink jet recording method which discharges ink with respect to a recording medium using the ink jet recording apparatus according to claim 4.

6. The ink jet recording apparatus according to claim 1, wherein each of the plurality of types of ink contains glycerin and out of nozzle arrays which are accommodated in one cap member, that a difference in glycerin content between an ink where the glycerin content is the highest and an ink where the glycerin content is the lowest is 4% or less.

7. The ink jet recording apparatus according to claim 6, further comprising:

two or more cap members, wherein two nozzle arrays which discharge ink for which the difference in the glycerin content exceeds 4% are arranged in regions of cap members which are different from each other.

8. An ink jet recording method which discharges ink with respect to a recording medium using the ink jet recording apparatus according to claim 7.

9. An ink jet recording method which discharges ink with respect to a recording medium using the ink jet recording apparatus according to claim 6.

10. The ink jet recording apparatus according to claim 1, wherein each nozzle discharges liquid droplets of ink which are 4 pL or less.

11. An ink jet recording method which discharges ink with respect to a recording medium using the ink jet recording apparatus according to claim 10.

12. The ink jet recording apparatus according to claim 1, wherein an ink absorbing material is provided in the cap member.

13. An ink jet recording method which discharges ink with respect to a recording medium using the ink jet recording apparatus according to claim 12.

14. The ink jet recording apparatus according to claim 1 which is configured so as to perform an operation of suctioning ink in the cap member after the flushing operation.

15. An ink jet recording method which discharges ink with respect to a recording medium using the ink jet recording apparatus according to claim 14.

16. An ink jet recording method which discharges ink with respect to a recording medium using the ink jet recording apparatus according to claim 1.

* * * * *